US006752092B2

(12) United States Patent
Beattie et al.

(10) Patent No.: US 6,752,092 B2
(45) Date of Patent: Jun. 22, 2004

(54) FIRE AND WATER-RESISTANT CONTAINER

(75) Inventors: Patrick J. Beattie, Rush, NY (US); James Masseth, Henrietta, NY (US); R. David Pallo, Fairport, NY (US)

(73) Assignee: John D. Brush & Co., Inc., Rochester, NY (US)

( * ) Notice: Subject to any disclaimer, the term of this patent is extended or adjusted under 35 U.S.C. 154(b) by 0 days.

(21) Appl. No.: 09/906,176

(22) Filed: Jul. 16, 2001

(65) Prior Publication Data

US 2003/0010263 A1 Jan. 16, 2003

(51) Int. Cl.[7] ..... E06B 7/16

(52) U.S. Cl. ..... 109/75; 109/73; 109/74; 109/80

(58) Field of Search ..... 109/25, 64, 73, 109/74, 76, 80; 220/849

(56) References Cited

U.S. PATENT DOCUMENTS

| | | | | |
|---|---|---|---|---|
| 101,245 | A | * | 3/1870 | Farrel et al. |
| 342,003 | A | * | 5/1886 | Gross |
| 718,878 | A | * | 1/1903 | Reynolds et al. |
| 773,269 | A | * | 10/1904 | Vanderman |
| 828,423 | A | * | 8/1906 | Ransom |
| 1,436,353 | A | * | 11/1922 | Ohnstrand |
| 1,986,057 | A | * | 1/1935 | Hackworth |
| 2,803,368 | A | | 8/1957 | Koch |
| 2,969,891 | A | * | 1/1961 | Presnick |
| 3,441,166 | A | * | 4/1969 | De Frees |
| 4,048,926 | A | | 9/1977 | Brush et al. ..... 109/65 |
| 4,541,545 | A | | 9/1985 | Beattie et al. ..... 109/80 X |
| 4,664,281 | A | | 5/1987 | Falk et al. ..... 220/3.8 |
| 4,688,493 | A | | 8/1987 | Brush, Jr. et al. ..... 109/65 |
| 4,721,227 | A | | 1/1988 | Hughes et al. ..... 109/84 X |
| 4,748,790 | A | * | 6/1988 | Frangolacci ..... 52/809 |
| 4,828,786 | A | | 5/1989 | Legg et al. ..... 264/515 |
| 4,893,397 | A | * | 1/1990 | Hughes ..... 109/65 X |
| 4,898,707 | A | | 2/1990 | Arp ..... 264/515 |
| 5,007,183 | A | * | 4/1991 | Kobayashi et al. .... 109/49.5 X |
| 5,069,358 | A | * | 12/1991 | Avery, Jr. ..... 220/426 |
| 5,201,867 | A | * | 4/1993 | Morszeck ..... 206/316.2 |
| 5,295,447 | A | | 3/1994 | Robbins et al. ..... 109/65 |
| 5,370,254 | A | | 12/1994 | Hardigg et al. ..... 220/325 X |
| 5,377,514 | A | | 1/1995 | Robbins et al. ..... 70/452 |
| 5,435,256 | A | * | 7/1995 | Svehaug ..... 109/65 |
| 5,971,515 | A | * | 10/1999 | Baker et al. ..... 109/74 X |
| 6,044,993 | A | * | 4/2000 | Yang ..... 220/849 X |

FOREIGN PATENT DOCUMENTS

| | | | | |
|---|---|---|---|---|
| DE | 2733775 | * | 2/1979 | ..... 109/75 |
| FR | 2391342 | * | 1/1979 | ..... 109/74 |

* cited by examiner

*Primary Examiner*—Lloyd A. Gall
(74) *Attorney, Agent, or Firm*—Jaeckle Fleischman & Mugel, LLP

(57) ABSTRACT

A fire-resistant container having a full gasket at the interface between hinged top and bottom mating elements. The elements are insulated and are formed with matable labyrinthine edges. One of the edges is provided with a smooth, soft gasket disposed in a groove in the labyrinth which forms a seal against a corresponding rib in the opposing edge. The elements are joined along common sides by a hinge, the rotational axis of which is positioned in space relative to the gasket and rib such that, in closing of the container, the gasket engages the rib at all points substantially simultaneously. The hinged elements are secured by an over-center latching latch such that when the container is fully closed the rib exerts a small and substantially uniform force against the gasket to form a seal against fire and water. Upon being exposed to fire, the hinges and/or the latch may be destroyed without causing the seal between to be broken, thus maintaining the fire- and water-resistance of the container, the weight of the top element further compressing the gasket onto the rib and thereby enhancing the seal.

10 Claims, 4 Drawing Sheets

FIRE AND WATER-RESISTANT CONTAINER

TECHNICAL FIELD

The present invention relates to fire-resistant containers; more particularly, to fire-resistant safes; and most particularly, to a safe container which is both fire-resistant and water-resistant.

BACKGROUND OF THE INVENTION

Containers for temporarily protecting their contents from damage from external heat sources such as fire are well known. Such containers are said in the art to be "fire-resistant" and typically are rated for integrity over a specific exposure temperature and/or time. Lockable fire-resistant containers are known as fire-resistant "safes" and are widely used for storage of documents or other valuables which may be damaged or destroyed by exposure to high temperatures. For example, various models of such fire-resistant safes are available from Sentry Group, Rochester, N.Y. 14625 USA.

A typical top-opening fire-resistant safe has top and bottom elements which are hinged and detachably latched together to form a storage cavity between the elements. Each element is initially hollow, having inner and outer shells which may be conveniently formed as by blow-molding or other known forming means. The interior of each element between the shells is filled with a non-combustible, fire-proof thermally-insulating material such as Portland cement, which typically is heavily hydrated. The shells are formed of polymeric resin having a melting point higher than the boiling point of water such that the hydration prevents the shells, and especially the outer shells, from melting or igniting for an extended period of time. See, for example, fire-resistant safes as disclosed in U.S. Pat. No. 5,295,447 issued Mar. 22, 1994 to Robbins et al., the relevant disclosure of which is hereby incorporated by reference, as are the various other US Patents incorporated by reference therein.

A common problem encountered in use of prior art fire-resistant safes is that they may be inundated with water from fire hoses during the fighting of a fire. Water may leak into the interior of a safe through the hinges and jamb and may ruin contents which have been otherwise preserved from damage by the fire. Such safes have no specific barrier to water entry, such as a resilient sealing gasket at the interface between the top and bottom elements. See, for example, the relevant disclosure of U.S. Pat. No. 4,541,545 issued Sep. 17, 1985 to Beattie et al.

One approach to making a fire-resistant safe also water-resistant is found in the construction of known "diving boxes" intended for underwater use wherein a jamb and corresponding gasket are provided around the entire periphery of the mating portions of the top and bottom elements. An external hinge connects the top and bottom elements, and the cover is locked by one or more over-center latches such that the gasket is highly compressed.

A problem arises is adapting this construction to fire- and water-resistant containers wherein the outer shell is progressively destroyed by fire. Because the gasket is so compressed, when either the hinge or the latches are first burned away, the resilience of the gasket can cause the safe to spring open enough to destroy the water seal. Further, if the axis of the hinge lies in or near the plane containing the sealing surfaces, the region including the surfaces nearest the hinge will become engaged the earliest during closing of the safe and the gasket may ultimately be more compressed in that region than in the region of the latch. Thus, when the hinges are burned away the safe may spring open even though the latch is still intact, exposing the contents to fire and/or water.

What is needed is a fire- and water-resistant container having a gasket at the interface between a top and a bottom element, the elements being hinged and latched together, wherein the gasket is lightly and evenly loaded over its entire length such that a fire- and water-resistant seal between the elements is maintained when the hinges and/or latch are destroyed.

It is the primary object of the invention to provide an improved fire-resistant and water-resistant safe for storage of documents or other valuables.

SUMMARY OF THE INVENTION

The invention is directed to a fire-resistant container which has a full gasket at the interface between highly-insulated top and bottom elements thereof which are rotated closed to a storage space therein. The elements are each formed with a labyrinthine edge surrounding the open side, the elements meeting matably along the edges. One of the edges, preferably the edge of the top element, is provided with a smooth, soft gasket disposed in a groove in the labyrinth which forms a seal against a corresponding rib in the opposing edge. The elements are joined along a first common side, preferably the back side, by at least one hinge, the rotational axis of which is positioned in space relative to the gasket and rib such that, in closing of the container, the gasket engages the rib at all points substantially simultaneously. The elements are secured along a second common side, preferably the front side, by over-center latching means such that when the container is fully closed the rib exerts a small and substantially uniform force against the gasket. Upon being exposed to fire, the hinges and/or the latch may be destroyed without causing the seal between the gasket and the rib to be broken, thus maintaining the fire- and water-resistance of the container. In a top-opening embodiment, the weight of the top element, when freed from gravitational restraint of the hinges and latch, further compresses the gasket onto the rib, enhancing the seal. In a further preferred embodiment, the gasket material is selected to be able to melt in place while the outer shells are being thermally destroyed, thus forming a viscous seal to enhance the integrity of the container. Preferably, the gasket material emits relatively small amounts of soot upon melting, and the seal prevents any soot generated from the exposed outer surfaces of the gasket from entering the container and damaging the contents.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings, in which.

DESCRIPTION OF THE PREFERRED EMBODIMENT

Figures 1, 2:
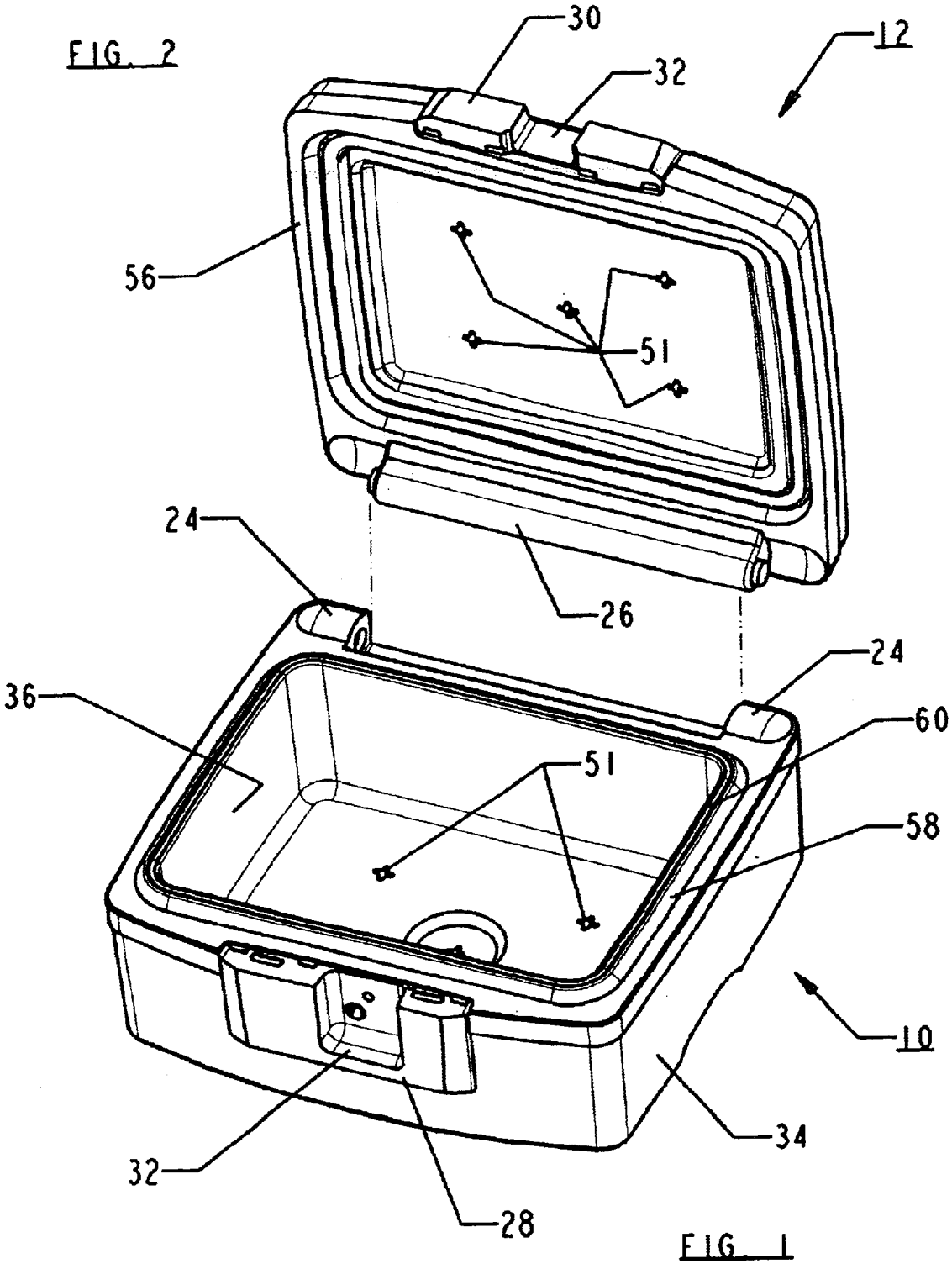
FIGS. 1 and 2 are isometric views from above of a bottom element and a top element, respectively, of a fire- and water-resistant container in accordance with the invention.
Figure 3:
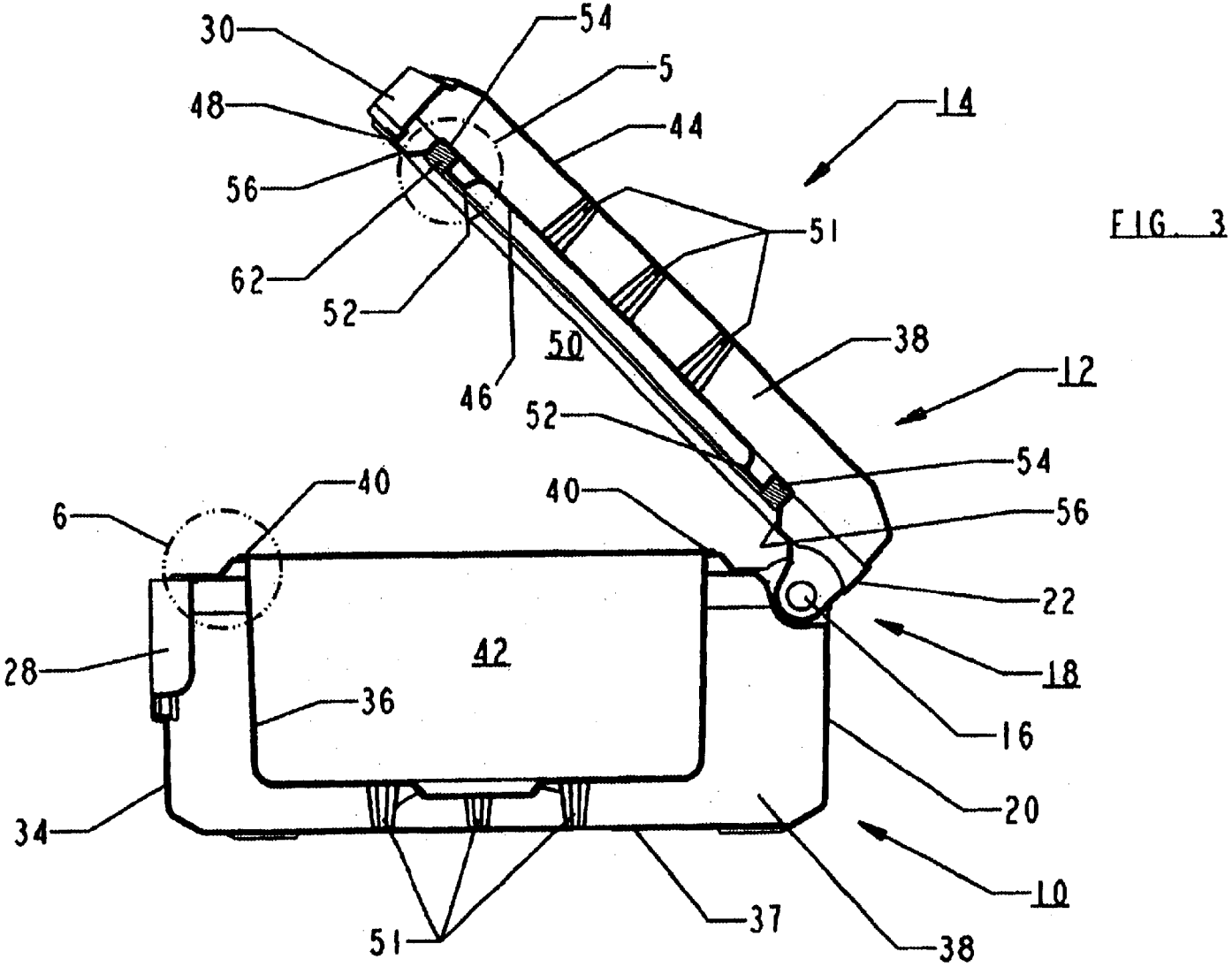
FIG. 3 is an elevational cross-sectional view of the top and bottom elements shown in FIGS. 1 and 2, hinged to form a fire- and water-resistant container, the container being shown in a partially-open position.
Figure 4:
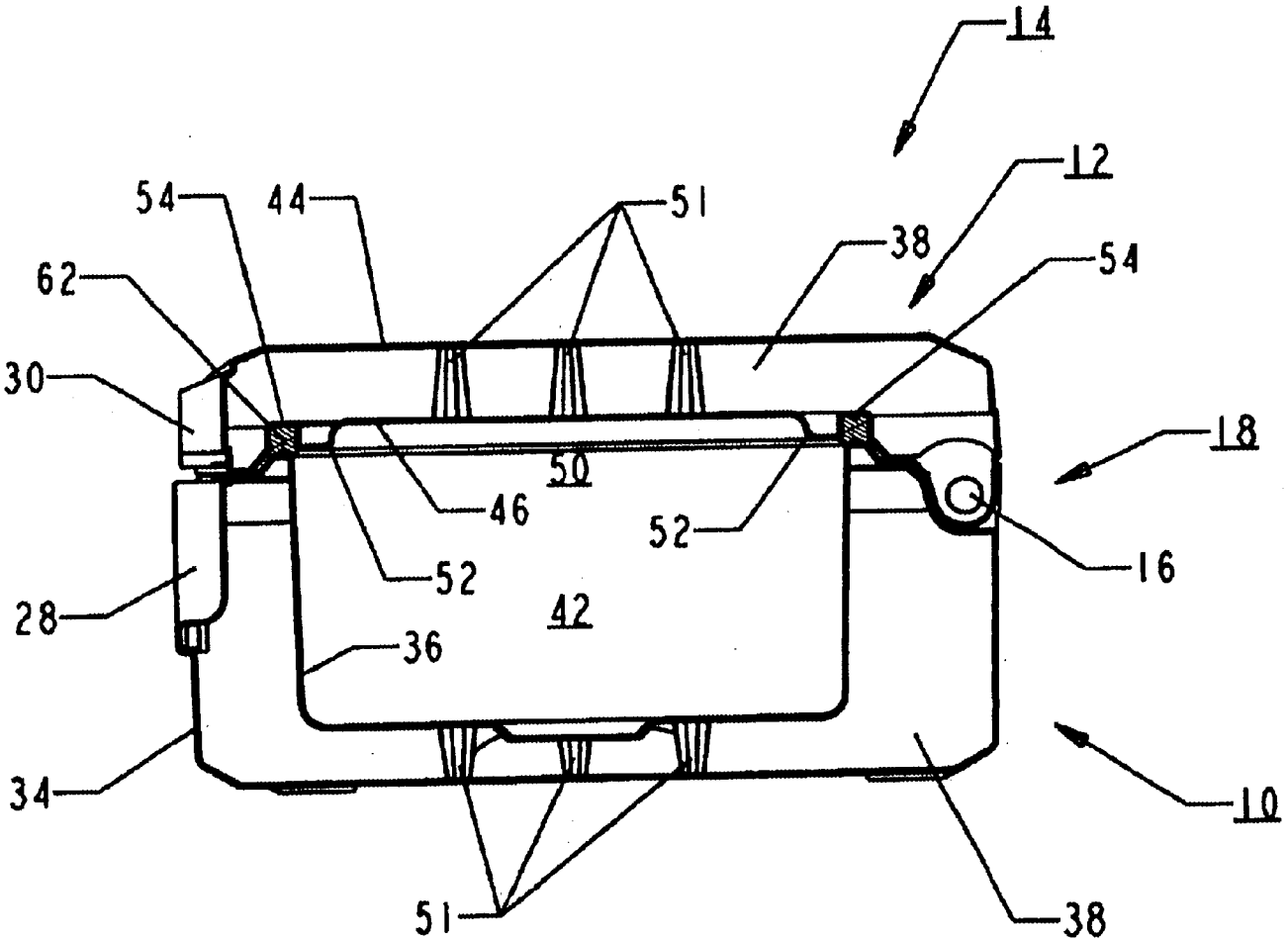
FIG. 4 is an elevational cross-sectional view like that shown in FIG. 3, showing the container in the closed position.
Figure 5:
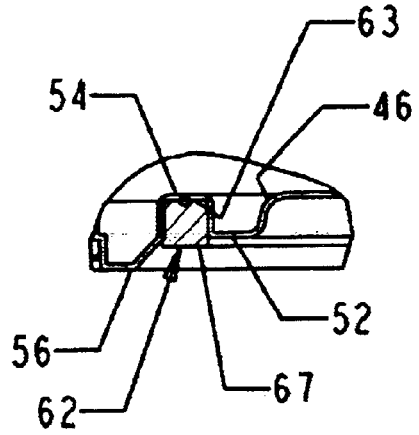
FIGS. 5 and 6 are detailed cross-sectional views taken from circles 5 and 6, respectively, in FIG. 3.
Figure 7:
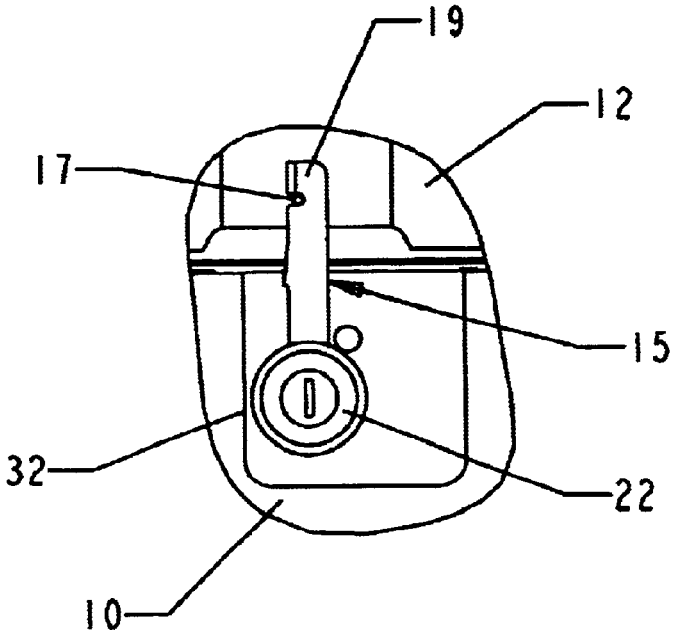
FIG. 7 is partial view illustrating a lockable closure suitable for use with the present invention.

Referring to FIGS. 1 through 4, a bottom element 10 and a top element 12 of a fire- and water-resistant container 14 in accordance with the invention are pivoted along a pivot axis 16 which is the axis of a hinge 18 extending along back outer surfaces 20,22 of elements 10,12, respectively. Hinge 18 includes female end members 24 formed in element 10 and a male center member 26 formed in element 12 for insertion into recesses in members 24 to complete the hinge. Elements 10,12 are further provided with first and second latch elements 28,30, respectively, for latching together to close container 14 as shown in FIG. 4. As shown in FIG. 7, each of latch elements 28,30 is provided with a slot 32 for receiving a conventional lockable closure 15, including a pin 17 in the top element 12 and a hook 19 engaging the pin 17 pivoted about a key lock 23, as is shown in U.S. Pat. No. 5,295,447 to Robbins et al. Preferably, the latch elements comprise a conventional overcenter mechanism such as is well known in the art and need not be further described.

Bottom element 10 includes an outer shell 34 and an inner shell 36 separated by a space which is filled with a fire-proof insulating material 38, preferably hydrated Portland cement. The outer shell 34 of bottom element 10 also includes a bottom surface 37. Shells 34, 36 may be formed of a metal but preferably are formed of a thermoplastic resin having a melting temperature higher than the boiling point of water. The formation of resin shells 34, 36, preferably by conventional blow-molding, and filling the space with insulation are fully described in the incorporated references. Shells 34, 36 are joined as by plastic welding along a knit line 40 surrounding a well 42 in shell 36. Well is the repository cavity for materials being stored in the container 14.

Like bottom element 10, top element 12 includes an outer shell 44 and an inner shell 46 separated by a space which is filled with a fire-proof insulating material 38. Shells 44,46 may be formed of metal but preferably are formed of a thermoplastic resin having a melting temperature higher than the boiling point of water. Resin shells 44,46, are formed and filled in the same way as shells 34,36. Shells 44,46 are joined as by plastic welding along a line 48 surrounding a shallow well 50 in shell 46.

Both inner shells 36,46 are provided with conical recesses 51 extending to the inner surfaces of outer shells 34,44. Recesses 51 provide structural reinforcements for maintaining a predetermined spacing between the inner and outer shells of the top and bottom elements, respectively. Such reinforcement prevents bowing between the shells, enables the elements to be filled with predetermined amounts of liquid insulating material, and assists in anchoring the hardened insulating material within the elements.

A labyrinthine gasket seal is provided between elements 10, 12 as follows. As shown in FIGS. 2–5, top inner shell 46 is formed having an inner ridge 52 surrounded by an intermediate groove 54 surrounded by an outer ridge 56, all of these features surrounding well 50 and defining a labyrinthine edge thereto. As shown in FIGS. 1, 3–4, and 6, bottom outer shell is formed having a ridge 58 surmounted by a rounded rib 60, both features surrounding well 42 and defining an upper edge 61 thereto. Outer shell 34 includes an outer contact surface 65 that opposes outer ridge 56 when container 14 is closed. An endless gasket 62 includes a contact surface 67, wherein gasket 62 is coupled with a lower edge 63 and press-fit into groove 54 for mating against rib 60 to form a fire- and water-resistant seal when container 14 is closed, as shown in FIG. 4.

Figure 6:
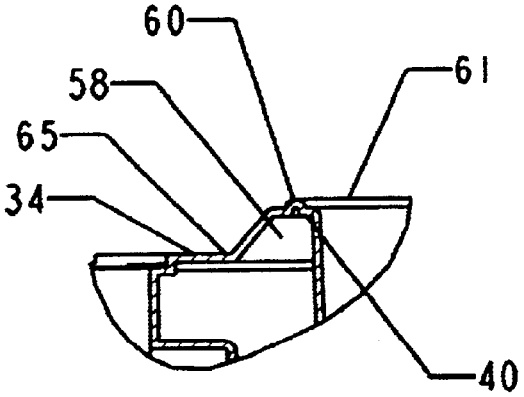

Gasket 62 is formed of a very low durometer and compliant elastomer, for example, ethylene propylene diene monomer (EPDM) or neoprene. It is a feature of the invention that the gasket be sufficiently resilient to form a seal against rib 60 but insufficiently resilient to be capable of displacing or launching top element 12 from rib 60 when the hinges or latch are destroyed by fire. Gasket 62 is preferably formed having a smooth outer surface and a cellular interior. The gasket may have any desired cross-sectional shape, and preferably is rectilinear, and shown in FIGS. 4–6, or round like an O-ring. The gasket may be uniform in structure throughout or may have a hollow center, as shown in FIG. 6.

A shortcoming of similar prior art seals is that the region of the sealing rib nearest the hinge engages the gasket at an angle significantly non-orthogonal. This can cause the rib to roll the gasket whereby the gasket may be deformed and/or displaced. Further, such non-uniform engagement of the rib and the gasket can result in the gasket's being more highly compressed in the region nearest the hinge. It is known that such non-uniform compression can cause a top element to be sprung away from the bottom element when the hinges are destroyed by fire, thus exposing the contents of the container to fire and/or water. Therefore, it is a feature of a container in accordance with the invention that the position of axis 16 with respect to the upper surface of rib 60 and the configuration of top element 12 are jointly selected such that, as the container is closed, gasket 62 makes contact with rib 60 substantially simultaneously at all positions along rib 62. In other words, planes including rib 60 and the surface of gasket 62 are substantially parallel at the moment of contact.

It will be obvious, of course, to those skilled in the art that the labyrinthine seal shown in FIGS. 1–6 may be formed to equal effect and within the scope of the invention by forming the gasket-bearing features in the bottom element and the mating rib in the top element.

In operation, when closed, container 14 sustains substantially uniform pressure of rib 60 against gasket 62 to form a seal against incursion of fire or water into wells 42 and 50. The highly hydrated Portland cement insulation provides a large thermal reservoir when the container is exposed to fire and forestalls significant fire damage to the outer shells while the water is being boiled off. At temperatures below the ignition temperature of the resin of the shells, the gasket begins to soften. When the hinge and/or latches are destroyed by fire, the top element settles gravitationally further onto rib 60 and the softened gasket seals even more tightly around the rib. When the outer portion of the gasket eventually begins to degrade and then burn, carbonaceous products of that degradation are prevented by the enhanced seal from entering container 14.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A container resistive of ingress by fire and water, comprising:

a) a bottom element having inner and outer shells spaced apart by an insulating material, having a bottom surface and a well opening in said inner shell for receiving materials to be sheltered from damage by fire and water, having a four-sided upper edge completely surrounding said well opening, and having an outer contact surface positioned outside of the upper edge and completely surrounding the said well opening;

b) a top element having inner and outer shells spaced apart by an insulating material and including a well opening in said inner shell, having a four-sided lower edge completely surrounding said top element well opening and opposing the upper edge of the bottom element, and having an outer ridge positioned outside of the lower edge and opposing the outer contact surface of the bottom element, and c) hinge means joining said top and bottom elements for enabling the top element to be pivoted relative to the bottom element, one of said edges including a resilient gasket along the entire length of the edge and having a contact surface included in a first plane and the other of said edges having a rib in a second plane along the entire length of the edge for mating with said gasket, said hinge means having an axis of rotation positioned off center, below the edge having the rib in the second plane, below at least a portion of the outer ridge of the top element and said outer contact surface of the bottom element when said container is in a closed position, and between the edge having the rib and the bottom surface of the bottom element so that the said planes are substantially parallel when said rib mates with said gasket and the rib applies a substantially uniform pressure along the entire length of the gasket to cause the gasket to seal tightly around the entire length of the rib by a substantially uniform compression of the gasket upon closure of said container.

2. A container in accordance with claim 1 wherein said gasket is formed of a low-durometer elastomer.

3. A container in accordance with claim 2 wherein said elastomer is selected from the group consisting of ethylene propylene diene monomer and neoprene.

4. A container in accordance with claim 2 wherein said gasket is formed having a smooth surface and a cellular interior.

5. A container in accordance with claim 4 wherein said gasket is hollow.

6. A container in accordance with claim 1 wherein said top and bottom outer shells are formed of a thermoplastic resin having an ignition temperature higher than the ignition temperature of said gasket causing the gasket when damaged by fire to seal even more tightly around the rib.

7. A container in accordance with claim 1 wherein the edge of the bottom element includes said rib and the edge of the top element includes said gasket.

8. A container in accordance with claim 1 wherein the edge of the bottom element includes said gasket and the edge of the top element includes said rib.

9. A container in accordance with claim 1 further comprising latch means disposed on said top and bottom elements for securing said container in a closed position.

10. A container in accordance with claim 9 further comprising locking means such that said container is suitable for use as a fire- and water-resistant safe.

* * * * *